United States Patent [19]

Siemer

[11] Patent Number: 5,014,680

[45] Date of Patent: May 14, 1991

[54] SELF-POWERED AUTOMATIC SECONDARY AIR CONTROLLERS FOR WOODSTOVES AND SMALL FURNACES

[75] Inventor: Darryl D. Siemer, Idaho Falls, Id.

[73] Assignee: The United States of America as represented by the United States Department of Energy, Washington, D.C.

[21] Appl. No.: 323,924

[22] Filed: Mar. 15, 1989

[51] Int. Cl.[5] ..... F24C 1/14

[52] U.S. Cl. ..... 126/77; 126/80; 126/289; 126/112; 236/99 C; 110/214

[58] Field of Search ..... 126/77, 15 R, 80, 290, 126/289, 112; 110/203, 205, 210, 211, 214; 236/99 R, 99 C, 99 E, 99 F

[56] References Cited

U.S. PATENT DOCUMENTS

| | | | |
|---|---|---|---|
| 990,772 | 4/1911 | Pollard | 236/99 C |
| 4,380,228 | 4/1983 | Crowley | 110/214 X |
| 4,607,610 | 8/1986 | Zimmermann | 126/77 |
| 4,691,686 | 9/1987 | Alvarez | 126/77 |
| 4,862,869 | 9/1989 | Hazard | 126/77 |

*Primary Examiner*—Larry Jones

*Attorney, Agent, or Firm*—Mark P. Dvorscak; Robert J. Fisher; William R. Moser

[57] ABSTRACT

A controller for automatically regulating the supply of secondary combustion air to woodstoves and small furnaces. The controller includes a movable air valve for controlling the amount of secondary air admitted into the chamber. A self powered means monitors the concentration of combustible gases and vapors and actuates the movable air valve to increase the supply of secondary air in response to increasing concentrations of the combustible gases and vapors. The self-powered means can be two fluid filled sensor bulbs, one of which has a coating of a combustion catalyst. Alternatively, the self powered means can be two metallic stripes laminated together, one of which is coated with a combustion catalyst, and when heated, causes the air valve to actuate.

35 Claims, 5 Drawing Sheets

SELF-POWERED AUTOMATIC SECONDARY AIR CONTROLLERS FOR WOODSTOVES AND SMALL FURNACES

CONTRACTUAL ORIGIN OF THE INVENTION

The U.S. Government has rights in this invention pursuant to Contract No. W-31-109-ENG-38 between the U.S. Department of Energy and the University of Chicago representing Argonne National Laboratory.

FIELD OF THE INVENTION

This invention relates to the regulation of combustion in woodstoves, small furnaces and the like, so as to produce efficient combustion, while maximizing the possible heat output and minimizing air pollution. More specifically, the invention relates to controllers for automatically regulating the supply of secondary combustion air to woodstoves, small furnaces or the like. For brevity, the subsequent references to woodstoves herein should be taken as including small furnaces and other similar heating devices.

BACKGROUND OF THE INVENTION

Woodstoves are widely manufactured and commonly used for space heating in areas where wood is abundant and inexpensive, and other fuels may be not as readily available and more expensive.

The design of woodstoves has progressed to include separate controllers for primary and secondary combustion air. Primary air controllers are available which are either manually operable or thermostatically operable, to provide automatic regulation of primary air in response to room temperature, so as to maintain a relatively constant room temperature. Secondary air controllers are available which are manually adjustable to promote efficient combustion. Certain automatic secondary air controllers have also been developed, but generally require electrical power to operate electrical or electronic components. In remote areas, electrical power may not be readily available, or may be somewhat unreliable and subject to outages, particularly during storm conditions. It is very desirable to provide woodstoves which do not require any electrical power, so that the woodstoves will be fully usable as regular or emergency space heaters, even during electrical power outages, which often occur in bad weather, when the reliable availability of heat is acutely important.

Some woodstoves are provided with catalytic combustion plates for catalytically promoting the complete combustion of carbon monoxide (CO) and hydrocarbon gases and vapors emanating from the primary combustion zone in a woodstove. Typically, a catalytic combustion plate comprises a ceramic grid or honeycomb, coated with a combustion catalyst such as platinum, palladium, or a mixture thereof, for example. An adequate but well regulated supply of secondary air is particularly important for the best operation of a catalytic combustion plate, for achieving substantially complete catalytic combustion, without any need for unnecessarily heating excess secondary air. Consequently, the provision of an automatic secondary air controller is particularly advantageous in a woodstove having a catalytic combustion plate.

SUMMARY OF THE INVENTION

One object of the present invention is to provide a new and improved automatic secondary air controller which is self-powered and does not require any supply of electrical power.

A further object is to provide such a new and improved secondary air controller which responds to the presence and concentration of combustible gases and vapors in the secondary combustion zone of a woodstove, so as to admit adequate but not excessive secondary air to achieve complete and efficient combustion.

To achieve these and other objects, the present invention provides various embodiments of a secondary air controller having a movable air regulating valve which is operable by differential forces or fluid pressures produced by two mechanical members in the secondary combustion zone, one of such members being heated by catalytic combustion while the other member is not similarly heated, although both members will be heated by the general abundance of combustion heat in the secondary combustion zone. The differential action has the effect of balancing the secondary air controller with respect to variations in the general temperature in the secondary combustion zone, while causing the controller to respond primarily to variations in the concentration of combustible gases and vapors in the secondary combustion zone. For brevity, the two members may be referred to as the active member and the passive member.

In certain embodiments, the active member is coated with a combustion catalyst while the passive member is not similarly coated, so that the active member is heated by localized catalytic combustion, while the passive member is not similarly heated.

In other embodiments, neither the active nor the passive member is coated with a catalyst, but the active member is positioned on or near the catalytic combustion plate, so as to be heated by the catalytic combustion occurring due to the catalyst on the plate. The passive member is located more remotely from the catalytic combustion plate, such as upstream toward the primary combustion zone from the catalytic combustion plate.

In certain embodiments, the active and the passive members produce differential fluid pressures which are transmitted to an actuator responsive to differential fluid pressures, for actuating the movable secondary air valve. The active and passive members may take the form of heat resistant bulbs containing an inert gas or other suitable fluid, in which the differential pressures are developed. The differential pressures are transmitted by small tubes to the differential actuator. In certain embodiments, the differential actuator takes the form of a pair of flattened and curved Bourdon tubes, of the general type often used in pressure gauges, which are differentially connected by balanced springs or other means to the secondary air valve. Other types of differential pressure operated actuators can be employed, such as differential diaphragm type actuators, for example.

In another embodiment of the gas filled bulb type, neither bulb needs to be catalyst-coated. The active bulb is mounted in, on or near a catalytic combustion plate, so as to be heated by the catalytic combustion which occurs due to the plate. The passive bulb is located more remotely from the catalytic combustion plate, generally upstream a short distance from the catalytic combustion plate toward the primary combustion zone. As before, the active and passive bulbs are connected to an actuator operable by differential fluid pressures. The actuator gradually changes the degree of opening and closing of the secondary air valve, so that additional secondary air is admitted in response to increased heating of the active bulb, due to increased catalytic heating of the catalytic combustion plate. The controller provides a negative feedback which keeps down the level of catalytic combustion on the surface of the catalytic combustion plate to a minimal or desirable level, whereby substantially complete combustion of the combustible gases is achieved, without admitting and unnecessarily heating an excessive supply of secondary air.

Certain other embodiments use the principle of differential thermal expansion and contraction of the active and passive members, which are typically in the form of elongated metal strips, riveted or otherwise fastened together, preferably with a sheet or layer of thermally insulating material therebetween, to form a laminated actuator strip. In one typical embodiment, the laminated actuator strip is loosely coiled to form a spiral actuating coil, superficially resembling the bimetallic spiral coils or springs which are so widely used in thermostatic devices. A bimetallic spring of this type becomes more tightly or more loosely coiled, in response to temperature increases or decreases. However, in the laminated actuating coil or spring of the present invention, both metal strips are made of the same material, which must be highly heat resistant, to maintain mechanical integrity and springiness at the high combustion temperature prevailing in the secondary combustion zone of the woodstove. In the present invention, the laminated active and passive strips differ in that the active strip is coated with a combustion catalyst, while the passive strip is not similarly coated. Thus, in the presence of combustible gases and at least a minimal amount of secondary air, the active strip (but not the passive strip) is subject to heating by localized catalytic combustion, along the surface of the strip, although some heat is conducted or otherwise transmitted between the two strips. The thermal insulating material between the active and passive strips reduces the conduction of heat therebetween, so that the differential heating effect is greater. The laminated actuating coil is firmly mounted at one end, but the other end is connected to a rotary shaft adapted to operate a rotary air valve, which may be of the butterfly type, for example, for regulating the supply of secondary air to the secondary combustion zone. A small initial supply of secondary air is directed at all times to the immediate locality of the laminated actuator coil, to insure that there will be enough secondary air to support localized catalytic combustion of the available combustible gases, along the surface of the catalyst-coated metal strip.

The laminated spiral actuating coil gradually opens and closes the secondary air valve, to regulate the supply of secondary air to an optimal condition, in which only a minimal amount of catalytic combustion is occurring along the active surface of the coil. The secondary air controller provides a negative feedback action, so as to admit an amount of secondary air which is sufficient to keep down the degree of catalytic combustion along the active surface of the spiral actuating coil.

Instead of using a laminated coil, the air controller may comprise an actuator having one or more laminated strips which are basically straight and are caused to warp or bend due to differential thermal expansion and contraction of the active and the passive components of the strip. This type of actuator is arranged to produce linear movement of a secondary air valve, which may be in the form of a damper plate, adapted to change the degree of opening and closing of the conduit through which secondary air is admitted to the secondary combustion zone. Again, the active component of the laminated actuating strip is coated with a combustion catalyst, while the passive component is not similarly coated, so that differential heating of the components occurs in the presence of combustible gases and at least a minimal amount of secondary air.

BRIEF DESCRIPTION OF THE DRAWINGS

Further objects, advantages and features of the present invention, will appear from the following detailed description, taken with the accompanying drawings, in which.

DETAILED DESCRIPTION OF ILLUSTRATIVE EMBODIMENTS

Figure 1:
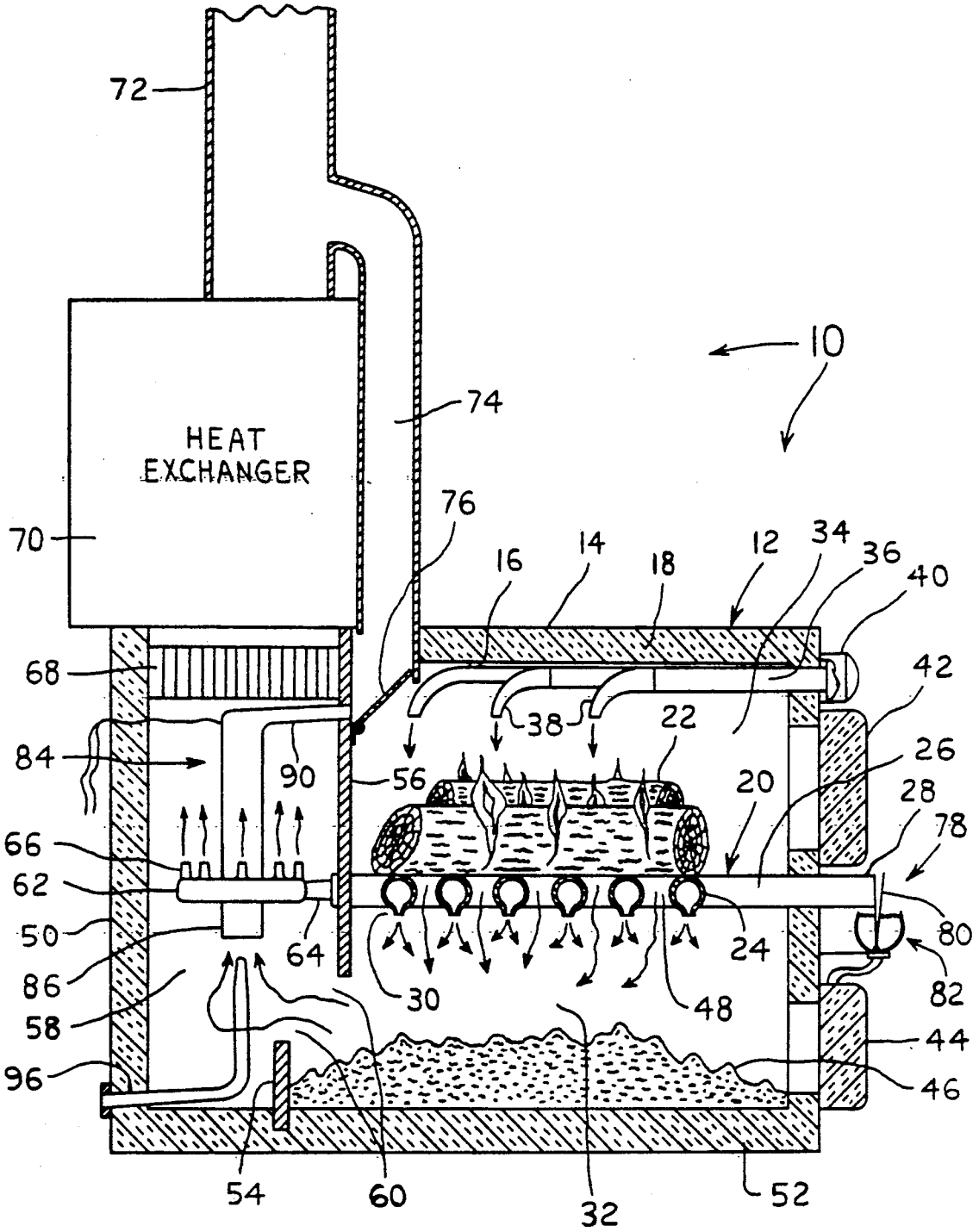
FIG. 1 is a general diagrammatic elevational section, taken through a woodstove having a self-powered automatic secondary air controller to be described as an illustrative embodiment of the present invention.

As just indicated, FIG. 1 shows an illustrative embodiment of the present invention, incorporated into a woodstove 10 having an outer housing or firebox 12, which is double-walled, in that the firebox 12 has outer and inner walls 14 and 16, with thermal insulation 18 therebetween, for the purpose of maintaining a high combustion temperature in the firebox 12 to promote efficient and complete combustion. The woodstove 10 could also be regarded as a small furnace, and the invention is applicable to small furnaces and other similar heating devices.

A tubular grate structure 20 is mounted within the firebox 12, for supporting solid fuel in the form of logs or other pieces of firewood 22. The grate structure 20 comprises a plurality of spaced tubes 24, branching from a main tube 26, which carries and distributes secondary air and has an inlet portion, extending out of the firebox 12 and serving as an inlet conduit 28 for secondary air. Each of the branching tubes 24 has a plurality of downwardly directed openings or nozzles 30, through which secondary air is directed downwardly into a secondary combustion chamber or zone 32, in the lower portion of the firebox 12, and below the grate structure 20.

The firebox 12 also has an upper chamber or zone above the grate structure 20 and serving as a primary combustion chamber or zone 34. Primary air is admitted into the primary combustion chamber 34 through a primary air inlet tube 36, extending from the outside air into the primary combustion chamber 34 and having a plurality of branch discharge tubes or nozzles 38 for directing primary air downwardly toward the firewood 22 on the grate structure 20. Thus, the woodstove 10 is of the downdraft type, in which the primary air travels downwardly past the firewood 22 and through the spaces in the grate structure, into the secondary combustion chamber 32. The woodstove 10 has the advantage that both the primary air and the secondary air are preheated before being discharged into the primary and secondary combustion chambers. Such preheating promotes efficient combustion. The amount of primary air admitted into the inlet tube 36 is regulated by a known or suitable primary air controller 40, which is either manually or thermostatically regulated. Such primary air controllers are well known and commercially available. Increasing the supply of primary air through the controller 40 increases the amount of combustion heat produced by the woodstove 10, while decreasing the supply of primary air has the opposite effect. The known thermostatic primary air controllers regulate the amount of primary air as an inverse function of the room air temperature, so as to maintain a relatively constant room air temperature, in accordance with the temperature setting of the thermostatic primary air controller. When the room air temperature is too low, the controller increases the flow of primary air into the inlet tube 36, and vice versa.

The firebox 12 has a fuel loading door 42 which can be swung open to load the firewood 22 into the primary combustion chamber 34, where the firewood 22 is placed on the grate structure 20. In addition, the firebox 12 has an ash removal door 44 which can be swung open when it is desired to remove the accumulation of ashes 46 from the lower portion of the secondary combustion chamber 32, below the grate structure 20. The burning of the firewood 22 results in the production of hot ashes and hot coals which fall through the spaces 48 between the grate tubes 24. The hot ashes and coals assist in producing intensely high temperatures in the secondary combustion chamber 32 to promote efficient and complete combustion of the combustible gases and vapors therein, assuming that an adequate supply of secondary air is admitted to the secondary combustion chamber 32. The combustible gases and vapors include carbon monoxide and hydrocarbon gases and vapors which are gasified or vaporized from the burning firewood 22.

The illustrated firebox 12 has an outer or main rear wall 50, forming the rear wall of the secondary combustion chamber 32. The firebox 12 also has a lower or bottom wall 52 on which the ashes 46 are deposited. In the illustrated construction, the rearward spreading of the ashes 46 is limited by a partial partition wall or bulkhead 54, extending upwardly a short distance from the bottom wall 52 and spaced forwardly from the rear wall 50.

In the firebox 12, the rear of the primary combustion chamber 34 is closed off by a suspended partial vertical wall or partition 56 which is spaced forwardly from the rear wall 50 and is offset forwardly from the bulkhead 54. The suspended partition 56 supports the rear portion of the grate structure 20 and is shown as projecting downwardly a short distance below the grate structure 20. With this construction, there is an additional combustion chamber or zone 58 which is located behind the suspended partition 56, but is really a supplemental secondary combustion zone or chamber, constituting a continuation of the secondary combustion chamber 32, because there is a large passage or space 60 bounded by the bulkhead 54 and the suspended partition 56 and extending between the secondary combustion chamber 32 and the supplemental secondary combustion chamber 58. The hot products of combustion and any remaining combustible gases and vapors travel through the passage 60 into the chamber 58.

The woodstove 10 also includes means for introducing additional secondary air into the supplemental secondary combustion chamber 58, such means being illustrated as a hollow heat resistant ring 62 having a stub pipe 64 mounted on and connected to the rear end of the main grate tube 26, so that secondary air is transmitted from the grate tube 26 to the interior of the ring 62, from which the air is discharged upwardly through a plurality of nozzles or openings 66. The additional secondary air promotes additional secondary combustion of the remaining combustible gases and vapors.

As shown, a catalytic combustion plate or grid 68 extends across the upper end of the supplemental secondary combustion chamber 58, so that hot products of combustion and remaining combustible gases and vapors pass through the openings in the grid 68. The catalytic combustion plate 68 may be of any known or suitable construction, and typically is in the form of a ceramic honeycomb grid, coated with a very thin layer of a combustion catalyst, such as platinum, palladium, or a mixture of platinum and palladium. The hot products of combustion, passing through the plate or grid 68, heat it to a high temperature. The catalyst causes catalytic combustion of any remaining combustible gases or vapors, so as to afford a high degree of assurance of virtually complete combustion of all combustibles by the woodstove 10. The catalytic combustion generates additional heat which causes additional heating of the plate 68 and the hot products of combustion, traveling upwardly from the plate 68.

Such hot products of combustion travel through a heat exchanger 70, illustrated simply as a box located above the supplemental combustion chamber 58. The heat exchanger 70 may be of any known or suitable construction, for extracting as much heat as possible from the hot products of combustion, and transferring the extracted heat to the room air, which is caused to circulate through the heat exchanger. From the upper end of the heat exchanger 70, the products of combustion are discharged upwardly into a flue or chimney pipe 72, which may itself serve as a chimney or be connected to a chimney. The heat exchanger 70 greatly reduces the temperature of the products of combustion which are discharged into the flue 72.

The woodstove 10 also includes a bypass pipe or conduit 74, leading directly from the upper rear extremity of the primary combustion chamber 34 to the flue 72. During normal operation of the woodstove 10, after combustion has been established in the firebox 12, the lower end of the bypass conduit 74 is kept closed at its lower end by a manually movable bypass control door 76, shown in its closed position in FIG. 1. When the woodstove 10 is to be lit or started from a cold start, the bypass door 76 is swung counterclockwise to an upright position, in which the lower end of the bypass conduit 74 is open to the upper rear extremity of the primary combustion chamber 34, to afford sufficient draft to facilitate the lighting of the firewood 22, while carrying the initial products of combustion out of the chamber 34 and into the flue 72. To light the firewood 22, it is also necessary to open the fuel loading door 42. When the door 42 has been closed, primary air is supplied to the chamber 34 through the primary air controller 40, the inlet pipe 36, and the primary air nozzles 38. When the combustion of the wood 22 has been established, the bypass door 76 is moved to its closed position, whereupon the woodstove 10 is shifted into its normal downdraft mode of operation, as previously described.

The combustion of the firewood 22 in the primary combustion chamber 34 produces hot products of combustion and also hot combustible gases and vapors, all of which pass downwardly through the spaces 48 in the grate structure 20, into the secondary combustion chamber 32 and then into the supplemental secondary combustion chamber 58. It is desirable to admit sufficient secondary air through the inlet pipe 28 to produce substantially complete combustion of the combustible gases and vapors, without admitting excessive secondary air, which simply has to be unnecessarily heated and tends to reduce the delivery of heat by the heat exchanger 70 to the room air.

In accordance with the present invention, the woodstove 10 is provided with a self-powered secondary air controller

Figure 3:
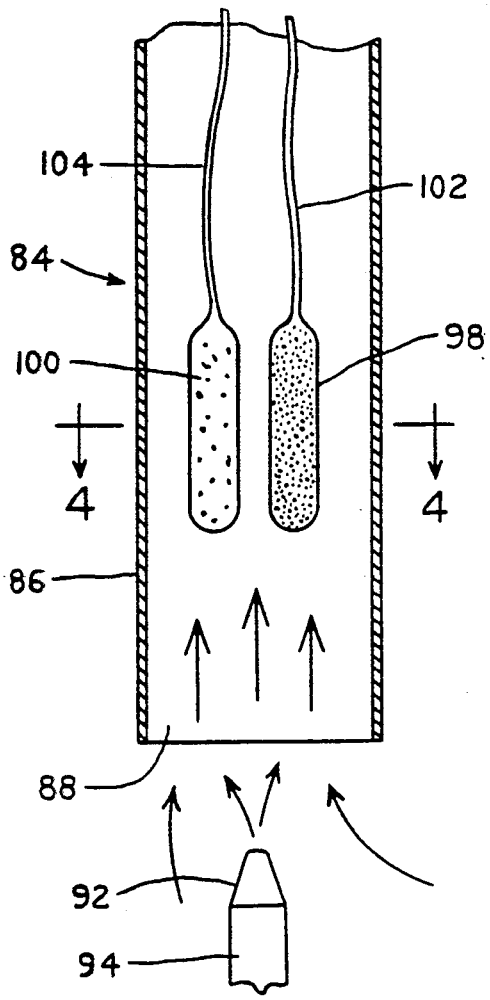
FIG. 3 is a fragmentary enlarged diagrammatic elevational section, corresponding to a left-hand portion of FIG. 1, showing a vertical section through a bypass tube which contains the active and passive fluid-filled sensor bulbs, the active bulb being coated with a combustion catalyst while the passive bulb is not similarly coated, the view also showing an inlet nozzle for admitting a small initial supply of secondary air to the lower end of the bypass tube.
Figure 2:
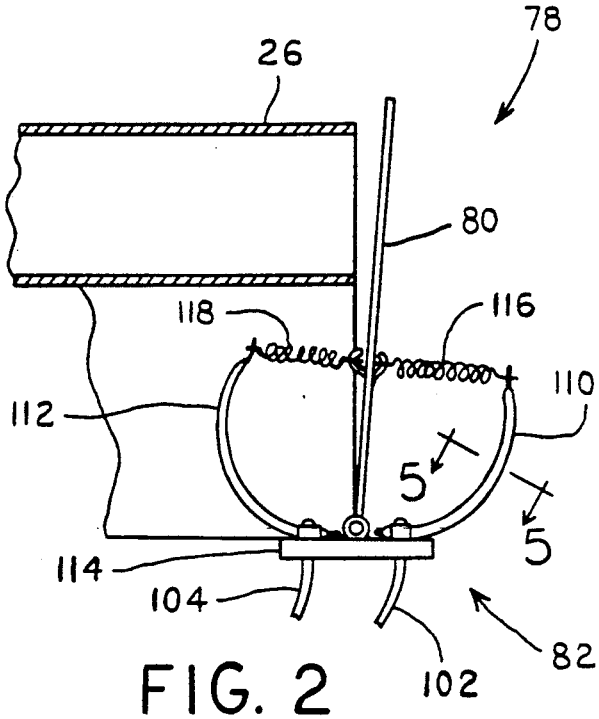
FIG. 2 is a fragmentary enlarged diagrammatic elevational section, corresponding to a portion of FIG. 1, and showing the differential pressure operated actuator for the secondary air regulating valve, the actuator having dual Bourdon tubes.
Figure 4:
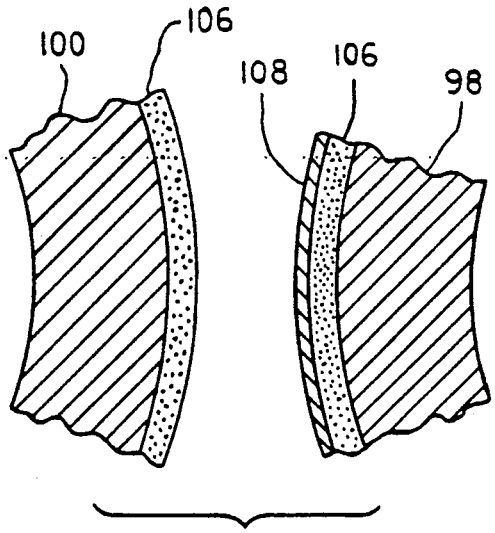
FIG. 4 is a greatly enlarged diagrammatic cross section, taken through the adjacent walls of the sensor bulbs, generally along the line 4—4 in FIG. 3.
Figure 5:
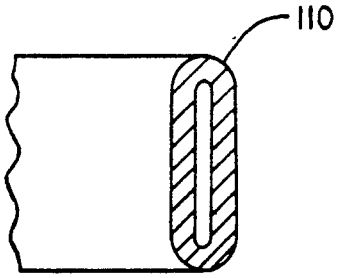
FIG. 5 is an enlarged fragmentary cross section, taken through one of the curved, flattened Bourdon tubes, generally along the line 5—5 in FIG. 2.

78, illustrated in FIGS. 1–5 as the first illustrative embodiment of the invention. The controller 78 produces the desired regulation of the secondary air, admitted into the inlet conduit 28. As shown in FIG. 1, the secondary air controller 78 comprises a movable secondary air valve in the form of a plate 80 which is swingable toward and away from the end of the secondary air inlet conduit 28. An actuator 82 is provided to operate the air valve plate 80. Details of the actuator 82 are illustrated in FIGS. 2 and 5. The illustrated actuator is operable by differential fluid pressures from a sensor unit 84, details of which are shown in FIGS. 3 and 4.

As illustrated in FIGS. 1 and 3, the sensor unit 84 includes a housing in the form of a bypass tube 86, located in the supplemental secondary combustion chamber 58, and extending vertically therein, which is the direction in which the hot gases and vapors extend upwardly toward the catalytic combustion plate 68. As shown in FIG. 3, the bypass tube 86 has an open lower end or entrance 88, through which some of the hot gases pass upwardly into the tube 86. As shown in FIG. 1, the upper end portion of the bypass tube 86 is in the form of a laterally and upwardly extending exit tube 90, discharging directly into the lower portion of the bypass conduit 74 which leads upwardly to the flue 72. Because of this connection, an upward draft is produced in the bypass tube 86, to insure that an adequate sample of the hot gases will be drawn into the bypass tube 86, so as to travel upwardly therein. Thus, the bypass tube 86 may be regarded as a sampling tube. As shown in FIG. 1, the bypass tube 86 extends through the ring 62, from which additional secondary air is admitted into the upper portion of the supplemental secondary combustion chamber 58. Thus, the bypass tube 86 samples the hot gases at a location which is upstream from the secondary air admitting ring 62.

A small amount of initial secondary air is supplied and directed into the open lower end 88 of the bypass tube 86 by a small nozzle 92 at the upper or discharge end of a small air tube 94 having a laterally extending lower or entrance portion 96 connecting with the room air. The nozzle 92 and the air tube 94 operate in the manner of a small orifice or leak, to insure that a small amount of initial secondary air will always be admitted into the lower end or entrance 88 of the bypass tube 86, to support combustion therein.

As shown in FIG. 3, the sensor unit 84 includes means for detecting the presence and concentration of combustible gases and vapors in the sampled hot gases and vapors which pass upwardly through the bypass tube 86 from the supplemental secondary combustion chamber 58. Such means are illustrated as comprising first and second fluid-filled bulbs 98 and 100, made of a highly heat resistant material and containing an inert gas, such as argon, or some other suitable fluid, the pressure of which will increase with increasing temperature. The material of the bulbs 98 and 100 may be any known or suitable highly heat resistant metal or metal alloy, or a ceramic material, for example. The bulbs 98 and 100 have small corresponding outlet tubes 102 and 104 which transmit the fluid pressures to the differential actuator 82. The connecting tubes 102 and 104 have very fine bores, to minimize the fluid volume therein.

As shown in FIG. 4, each of the bulbs 98 and 100 is made of a highly heat resistant metal or metal alloy material, with a coating or layer of ceramic material 106 applied to the outer surface thereof. Only the first bulb 98 has an additional thin coating or layer of a combustion catalyst 108, applied to the outer surface of the ceramic layer 106. The combustion catalyst 108 may be made of any known or suitable material, capable of producing catalytic combustion, preferably platinum, palladium, or a mixture of platinum and palladium. The second bulb 100 does not have any combustion catalyst thereon. As previously indicated, the catalyst-coated bulb 98 may be referred to as the active member, while the second bulb 100 may be referred to as the passive member.

In the absence of the combustion catalyst 108, both of the bulbs 98 and 100 would be heated to the same high temperature by the hot gases and vapors flowing upwardly through the bypass tube 86 and around the bulbs 98 and 100. Thus, the same gas or fluid pressure would be produced in both bulbs 98 and 100. The actuator 82 responds only to differential pressures, so that changes in the temperature of the hot gases entering the tube 86 do not cause the actuator 82 to produce any movement of the secondary air valve 80. If there is no substantial concentration of combustible gases or vapors flowing past the bulbs 98 and 100, no substantial catalytic combustion takes place along the active bulb 98, and the bulbs 98 and 100 are equally heated, so that differential pressures are not produced. Consequently, there is no response by the actuator 82. However, if the hot gases flowing past the bulbs 98 and 100 contain any substantial concentration of combustible gases or vapors, catalytic combustion thereof is produced along the surface of the first or active bulb 98, on which the combustion catalyst 108 is deposited. The bulb 98 is heated by the catalytic combustion to a temperature higher than that of the passive bulb 100, so that the fluid pressure in the bulb 98 becomes greater than the fluid pressure in the bulb 100. The differential actuator 82 responds to the greater pressure in the catalyst-coated bulb 98, so as to cause opening movement of the air valve 80, whereby an increased supply of secondary air is admitted into the secondary air inlet conduit 28. The additional secondary air causes additional secondary combustion in the secondary combustion chambers 32 and 58, with the result that the concentration of combustibles entering the bypass pipe 86 is reduced. Correspondingly, the catalytic combustion along the surface of the active bulb 98 is reduced, so that the additional heating of the bulb 98 is reduced. In response, the actuator 82 tends to cause a small closing movement of the air valve 80 so as to reduce the intake of secondary air. It will be evident that the sensor unit 84 and the actuator 82 produce a negative feedback control, so that the secondary air controller 78 has the effect of adjusting the secondary air intake to an optimal amount, at which there is only a minimal level of catalytic combustion taking place around the active bulb 98. As a result, efficient and substantially complete secondary combustion occurs in the chambers 32 and 58. Virtually all remaining combustibles which reach the catalytic combustion plate 68 are consumed by catalytic combustion along the honeycomb openings of the plate 68, so that substantially all of the combustibles have been burned before the hot gases pass from the plate 68 into the heat exchanger 70. There is virtually no discharge of combustibles into the flue 72, so that the woodstove 10 does not discharge any significant amount of combustibles into the atmosphere, whereby air pollution is minimized.

As illustrated in FIGS. 1, 2 and 5, the differential actuator 82 comprises first and second devices in the form of Bourdon tubes 110 and 112, adapted to produce mechanical actuation in response to the first and second pressures from the first and second sensor bulbs 98 and 100, which are connected to the Bourdon tubes 110 and 112 by the fine-bored outlet tubes 102 and 104. The Bourdon tubes 110 and 112 are of the type often used in pressure gauges. Thus, each of the Bourdon tubes 110 and 112 is curved, as shown in FIG. 2, and has a flattened cross section, as shown in FIG. 5. The Bourdon tubes 110 and 112 are made so that the fluid volume therein is small. One end of each of the Bourdon tubes 110 and 112 is firmly anchored to a solid base 114. The movable or free ends of the Bourdon tubes 110 and 112 are connected to opposite sides of the secondary air valve plate 80 by balanced springs, illustrated as first and second coil springs 116 and 118.

Fluid pressure in the curved Bourdon tubes 110 and 112 causes straightening movement of the Bourdon tubes, which are oppositely oriented, as well as being connected in opposite directions to the swingable valve plate 80, so that equal gas pressures in the Bourdon tubes 110 and 112 will merely stretch the balanced springs 116 and 118, without producing any movement of the valve plate 80. However, when the gas pressure is greater in the first Bourdon tube 110 than in the second Bourdon tube 112, due to heating of the first or active bulb 98 by catalytic combustion along the surface thereof, the first Bourdon tube 110 straightens to a greater extent than the second Bourdon tube 112. As a result, the spring 116 moves the valve plate 80 clockwise or to the right, as shown in FIG. 2, so as to open up a greater space between the valve plate 80 and the end of the secondary air inlet conduit 28, whereby additional secondary air is admitted into the inlet conduit 26. It will be evident that the opening movement of the secondary air valve 80 is responsive to differential gas pressure between the first and second Bourdon tubes 110 and 112. When there is a reduction in such differential pressure, the Bourdon tube 110 moves back toward the same curvature as that of the Bourdon tube 112, so that closing movement of the air valve 80 is produced.

The automatic secondary air controller 78 of FIGS. 1–5 has the advantage of being self-powered, in that no electrical or other external operating power is required. The operating power is supplied by the gas pressures produced in the first and second sensor bulbs 98 and 100 due to the differential heating thereof.

Figure 6:
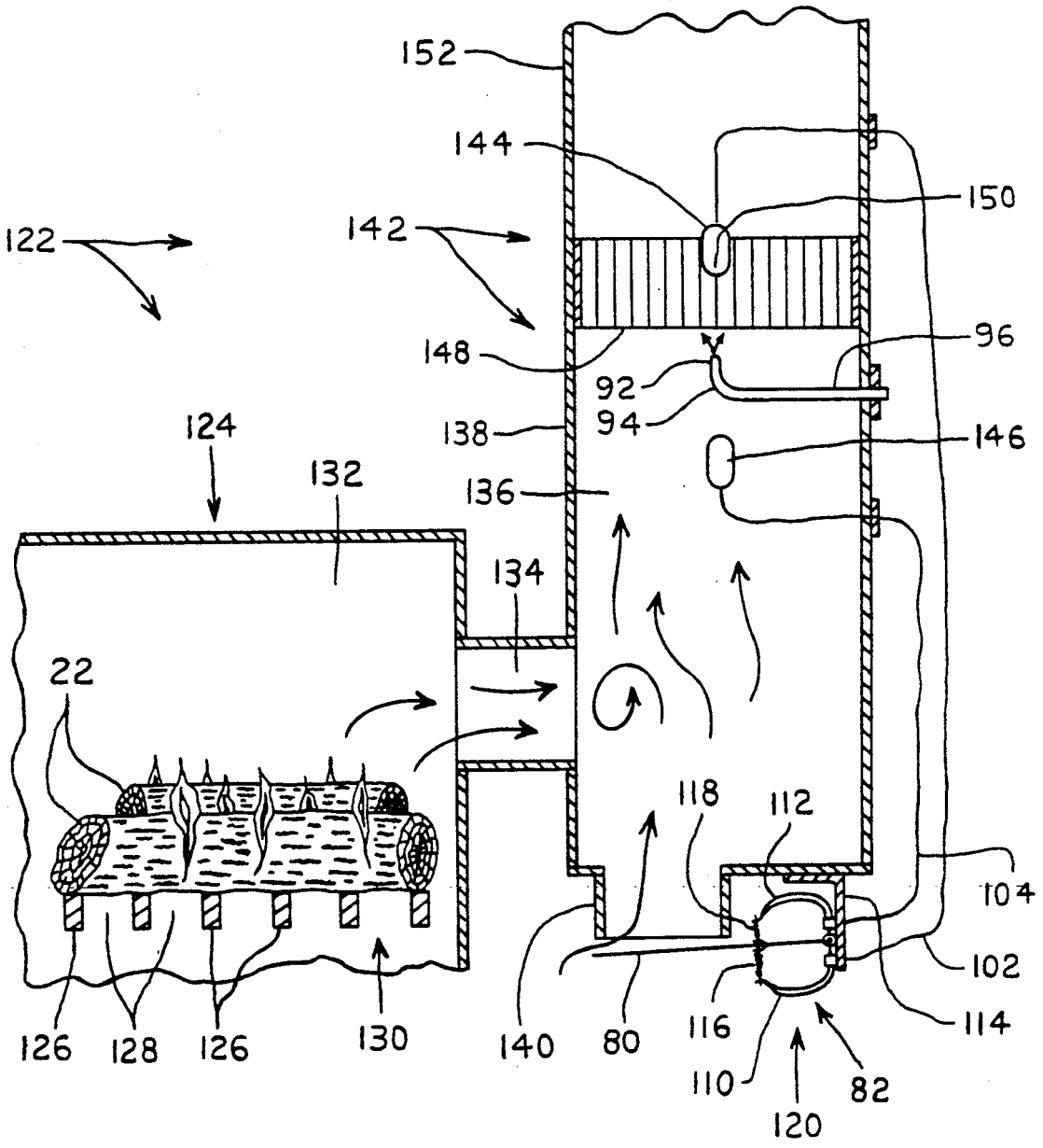
FIG. 6 is a diagrammatic elevational section taken through a modified woodstove having a modified self-powered automatic secondary air controller, to be described as another embodiment of the present invention, the controller including active and passive fluid-filled sensor bulbs, neither of which is catalyst-coated, the active bulb being recessed into a catalytic combustion plate, while the passive bulb is positioned more remotely from the plate, on the upstream side thereof.

FIG. 6 illustrates a modified self-powered automatic secondary air controller 120 constituting another illustrative embodiment of the present invention. The modified secondary air controller 120 is similar in many respects to the secondary air controller 78 of FIGS. 1–5, so that only the differences need be described in detail. To avoid unnecessary repetition of the detailed description, the same reference characters are being applied to various components illustrated in FIG. 6, to the extent that such components are essentially the same as illustrated in FIGS. 1–5. Thus, the modified secondary air controller 120 employs essentially the same movable secondary air valve 80 and essentially the same differential pressure operated actuator 82, as previously described. The only difference resides in the orientation of the movable air valve 80 and the actuator 82, in that these components have been reoriented through approximately 90 degrees, so that the air valve plate 80 is approximately horizontal in FIG. 6, while being approximately vertical in FIGS. 1 and 2. In FIG. 6, the same reference characters as previously used have been applied to the first and second connecting tubes 102 and 104, the first and second Bourdon tubes 110 and 112, the solid base 114, and the first and second coil springs 116 and 118.

The modified secondary air controller 120 of FIG. 6 could be employed in connection with the exact woodstove 10 of FIG. 1, but FIG. 6 actually illustrates a somewhat modified woodstove 122 which is shown quite diagrammatically. The woodstove 122 of FIG. 6 is of a conventional updraft construction, rather than the downdraft construction of the woodstove 10, previously described. Thus, in FIG. 6, the woodstove 122 comprises a firebox 124 having a plurality of horizontal generally parallel grate bars 126 therein for supporting the firewood 22. Spaces 128 are provided between the grate bars 126 for the passage of primary air upwardly to the firewood 22 from a primary air chamber or zone 130, located in the firebox 124 below the grate bars 126. Ashes also fall through the spaces 128, as the firewood 22 is burned. The supply of primary air may be controlled as described and illustrated in connection with FIG. 1.

Above the grate bars 126, the firebox 124 has a firewood loading compartment 132, which also serves as a primary combustion chamber or zone, from which hot gases travel through a passage 134 into a secondary combustion zone or chamber 136 in a housing 138 which may be tubular and cylindrical in shape, for example. Secondary air is admitted into the chamber 136 through a secondary air inlet pipe 140, corresponding generally with the secondary air inlet 28 of FIG. 1. The secondary air valve plate 80 is adapted to regulate the amount of secondary air admitted into the inlet pipe 140, in that the air valve plate is movable toward and away from the end of the inlet pipe 140, so as to adjust the amount of space between the air valve plate 80 and the end of the inlet pipe 140. The purpose of the secondary air controller 120 is to adjust the secondary air to an optimal amount, which is sufficient to produce substantially complete and efficient combustion of the hot combustible gases and vapors in the chamber 136, yet is not excessive, which would reduce the efficiency of the woodstove 122 by causing unnecessary heating of excess secondary air.

In FIG. 6, the automatic secondary air controller 120 includes a modified sensor unit or system 142 comprising first and second fluid-filled sensor bulbs 144 and 146, corresponding generally with the sensor bulbs 98 and 100, previously described. As before, the sensor bulbs 144 and 146 are preferably filled with an inert gas and are made of a highly heat resistant material, such as a highly heat resistant metal or metal alloy, coated with a thin layer of ceramic material. However, in this case, neither of the sensor bulbs 144 and 146 is coated with a combustion catalyst, because the first sensor bulb 144 is located so as to be heated by catalytic combustion along the honeycomb passages in a catalytic combustion plate 148, corresponding generally with the catalytic combustion plate 68 of FIG. 1. The catalytic combustion plate 148 may be the same as the catalytic combustion plate 68, previously described, except that the catalytic combustion plate 148 of FIG. 6 is formed with a recess 150 for receiving the first sensor bulb 144, whereby heat generated by catalytic combustion in the plate 148 is transferred efficiently to the first sensor bulb 144.

The second sensor bulb 146 is located more remotely from the catalytic combustion plate 148, so that very little of the heat generated in the plate 148 by catalytic combustion is transferred to the second sensor bulb 146. As shown, the catalytic combustion plate 148 extends across the upper portion of the housing 138, in the path of the upward flow of the hot gases and vapors traveling upwardly from the secondary combustion chamber 136. The second sensor bulb 146 is spaced below the catalytic combustion plate 148, but upstream therefrom, relative to the stream of hot gases and vapors.

It will be evident that both of the sensor bulbs 144 and 146 are heated to an approximately equal extent by the flow of the hot gases and vapors resulting from the secondary combustion in the chamber 136, and also resulting from the primary combustion of the firewood 22 in the chamber 132. However, if the secondary combustion is incomplete in the chamber 136 so that hot combustible gases and vapors reach the catalytic combustion plate 148 and travel upwardly therethrough, additional heat is produced by catalytic combustion in the plate 148, and such additional heat is transferred to the first sensor bulb 144, so as to increase the gas pressure therein, to a value greater than the gas pressure in the second sensor bulb 146. As before, the first and second sensor bulbs 144 and 146 are connected to the first and second outlet tubes 102 and 10 which convey the gas pressures to the first and second Bourdon tubes 110 and 112 of the differential actuator 82. In response to the differential pressure between the bulbs 144 and 146, the actuator 82 moves the air valve plate 80 away from the end of the secondary air inlet 140, so as to increase the inletting space therebetween, whereby additional secondary air is admitted into the inlet 140. The negative feedback operation of the secondary air controller 120 is thus essentially the same as previously described in connection with the secondary air controller 78 of FIGS. 1-5.

As shown in FIG. 6, the modified woodstove 122 includes the previously described air nozzle 92 at the upper end of the small air tube 94, with its laterally extending lower or entrance portion 96 connecting with the room air, for admitting a small amount of initial secondary air to the upper portion of the secondary combustion chamber 136, just below the catalytic combustion plate 148. As shown, the air nozzle 92 is centrally located, above the centrally located sensor bulb 146 and below the central portion of the catalytic combustion plate 148, in which the recess 150 for the first sensor bulb 144 is located, whereby the air nozzle 92 directs a small stream of secondary air upwardly at all times, through the portion of the catalytic combustion plate 148 immediately below and around the sensor bulb 144, to insure that secondary air will be available to support catalytic combustion in the plate 148 around the sensor bulb 144, if combustibles are present in the hot gases and vapors reaching and passing through the catalytic combustion plate 148.

The general operation of the automatic secondary air controller 120 of FIG. 6 is essentially the same as the previously described operation of the secondary air controller 78 of FIGS. 1-5. The first and second sensor bulbs 144 and 146 cooperate with the differential Bourdon tube actuator 82, so that the secondary air valve 80 is adjusted to admit an optimal amount of secondary air into the secondary combustion chamber 136 through the inlet 140. The secondary combustion in the chamber 136 is nearly complete, so that the concentration of combustibles reaching the catalytic combustion plate 148 is kept down to a minimal amount, whereby only a small amount of catalytically generated heat is transferred from the plate 148 to the first sensor bulb 144. The hot gases contain virtually no combustibles after passing through the catalytic combustion plate 148, so that air pollution of the atmosphere is minimized. In FIG. 6, the housing 138 has an upper or discharge portion or conduit 152, above the catalytic combustion plate 148. Such discharge conduit 152 may lead to a heat exchanger and then to a flue, much the same as described in connection with FIG. 1.

The self-powered automatic secondary air controllers 78 and 120 of FIGS. 1-6 operate on the principle of differential thermal expansion of gases or fluids, contained in first and second members which are differentially heated due to catalytic combustion of combustible gases and vapors around the first member, but not around the second member, where no catalyst is provided thereon or nearby. The differential fluid pressures are supplied to an actuator which adjusts the position of a secondary air valve, for regulating the amount of secondary air admitted into a secondary combustion chamber.

Figure 7:
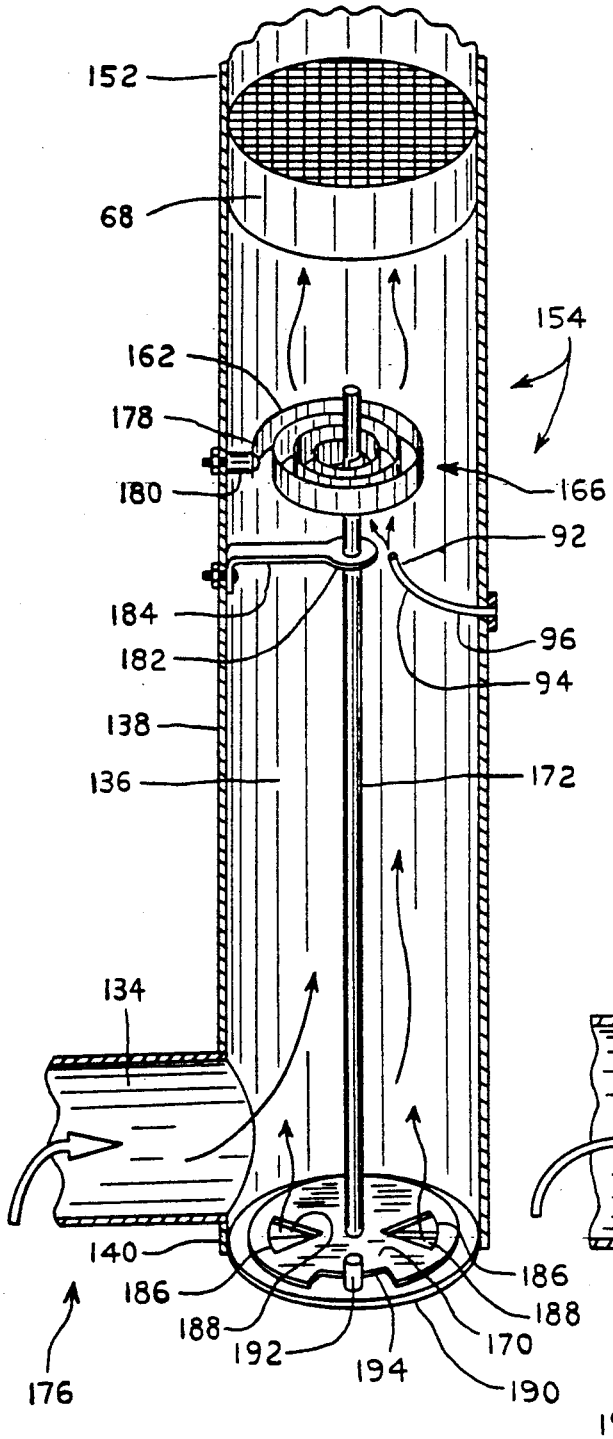
FIG. 7 is a fragmentary diagrammatic perspective of a modified self-powered secondary air controller, to be described as another illustrative embodiment of the invention, the controller including a laminated spiral actuating coil having active and passive metal laminations, the active lamination being coated with a combustion catalyst, while the passive lamination is not similarly coated, so that the coil is adapted to operate a rotary secondary air valve.
Figure 8:
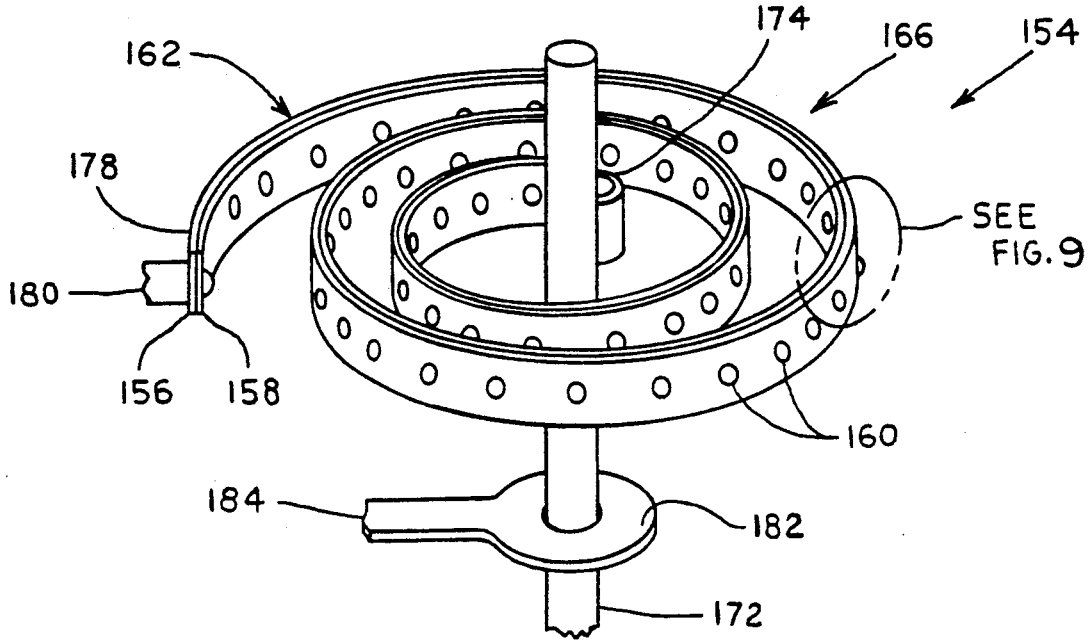
FIG. 8 is a fragmentary enlarged perspective view, corresponding to a portion of FIG. 7, and showing the laminated actuator coil in greater detail.
Figure 9:
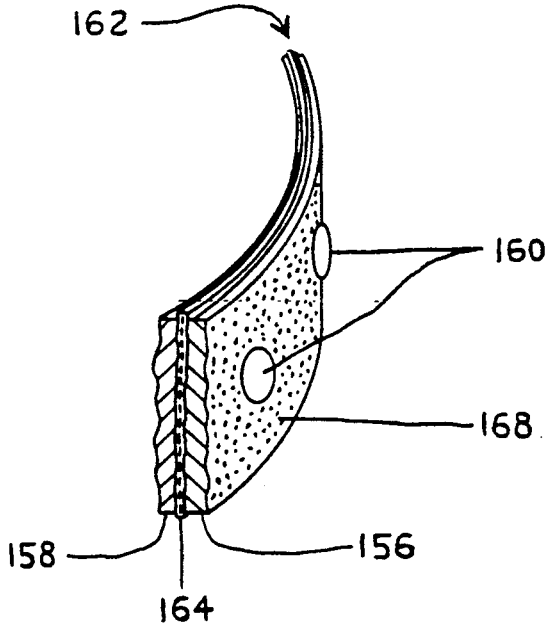
FIG. 9 is a fragmentary enlarged section, corresponding to a fragment of FIG. 8, as indicated by the legend in FIG. 8.

FIG. 7 illustrates another modified embodiment of the present invention, in the form of a modified self-powered automatic secondary air controller 154, which may be characterized as all-mechanical in construction. Details of the secondary air controller 154 are shown in FIGS. 8 and 9. The secondary air controller 154 utilizes the principle of differential thermal expansion and contraction of first and second mechanical members, illustrated as elongated strip members 156 and 158 which are fastened together by means of rivets 160 or other suitable means, to form a laminated strip 162. Preferably, a layer or strip 164 of heat insulating material is interposed between the strip members 156 and 158 of the laminated strip 162, to reduce heat conduction between the first and second strip members 156 and 158. In the preferred embodiment of FIGS. 7-9, the strip members 156 and 158, as well as the laminated strip 162, are curved and formed into a spiral coil 166 which superficially resembles a thermostatic bimetallic coil spring, of the type commonly used in conventional thermostats. However, the first and second strip members 156 and 158 are made of the same highly heat resistant metal, alloy or other suitable material so that both strip members 156 and 158 have the same coefficient of thermal expansion, rather than different coefficients, as in a conventional thermostat. The heat insulating strip 164 may be made of asbestos or some other suitable heat resistant material.

The first and second strip members 156 and 158 differ in that a thin coating of a combustion catalyst 168 is applied to one of the strip members, while the other strip member does not have any such coating. As shown most clearly in FIG. 9, the combustion catalyst 168 is applied to the first strip member 156, as indicated by the stippling in FIG. 9. The combustion catalyst 168 may be made of platinum, palladium, a mixture of platinum and palladium, or any other known or suitable catalytic material, capable of catalyzing the combustion of combustible gases and vapors, with the support of secondary air.

As shown most clearly in FIGS. 8 and 9, the catalyst-coated member 156 is the outer strip member of the spiral coil 166, so that additional heating of the strip member 156, due to catalytic combustion along its surface, causes additional curling or warping of the laminated strip 162, whereby the spiral coil 166 becomes more tightly coiled, relative to the condition in which both strips 156 and 158 are equally heated. When the catalytic combustion diminishes, the spiral coil 166 uncurls partially, toward its original coiled shape.

As shown in FIG. 7, the spiral coil 166 of the controller 154 is employed to actuate a rotary secondary air valve in the form of a generally circular disk or plate 170 connected by means of a rotary shaft 172 to the inner end portion 174 of the spiral coil 166.

The plate-type secondary air valve 170 is employed in connection with a modified woodstove 176, as shown in FIG. 7, which, however, is the same in most respects as the woodstove 122 of FIG. 6. Only the differences need to be described in detail. Many of the components of the woodstove 176 are the same as previously described. Where that situation prevails, the components in FIG. 7 have been given the same reference characters as in FIG. 6.

In FIG. 7, the components which are essentially the same as in FIG. 6 include the passage 134 leading from the firebox 124, which is not shown in FIG. 7; the secondary combustion chamber or zone 136 in the housing 138; and the secondary air inlet or pipe 140, at the lower end of the housing 138. Near the upper end of the housing 138, the catalytic combustion plate 68 of FIG. 1 is connected across the secondary combustion chamber 136. As in FIG. 6, the upper portion of the housing 138, above the catalytic combustion plate 68, forms a conduit 152 which may be connected to a heat exchanger and then to a flue, which are not shown in FIG. 7 but may be essentially the same as illustrated and described in connection with FIG. 1.

As shown in FIGS. 7 and 8, the outer end portion 178 of the spiral coil 166 is firmly anchored to a solid bracket 180, mounted on the wall of the housing 138, so that the outer end portion 178 of the coil 166 is kept stationary. The rotary shaft 172 is supported by the inner end portion 174 of the spiral coil 166, and is also guided and supported by a bearing member 182 on a solid bracket 184, mounted on the housing 138.

As shown in FIG. 7, the secondary air valve plate 170 is of the butterfly type, having a plurality of generally triangular or pie-shaped air openings 186 therein cooperating with similar openings 188 in a stationary plate 190, extending across the downwardly facing mouth of the secondary air inlet 140. The degree of registration of the pie-shaped openings 186 and 188 regulates the amount of secondary air admitted through such openings into the secondary air inlet 140 of the secondary combustion chamber 136. When the first or outer strip member 156 of the spiral coil 166 is heated by catalytic combustion, the spiral coil 166 curls into a more tightly coiled condition, so as to rotate the secondary air valve plate 170 in a clockwise direction. Such rotation increases the degree of registration of the openings 186 and 188, so that an increased amount of secondary air is admitted into the secondary combustion chamber 136. As shown in FIG. 7, the stationary plate 190 carries an upwardly projecting stop pin 192 which is received in a sector-shaped notch or slot 194 in the rotary valve plate 170, so as to limit the angle through which the plate 170 can be rotated.

As before, the secondary air controller 154 of FIG. 7 includes means for supplying a small amount of initial secondary air to a location which is upstream a short distance from the spiral coil 166 in the secondary combustion chamber. Such means comprise essentially the same components as employed in the embodiments of FIGS. 1 and 6, including the upwardly directed air nozzle 92 at the upper end of the small air tube 94, having its laterally extending entrance portion 96 connecting with the room air, through the wall of the housing 138, which supports the air tube 94. The air tube 94 and its nozzle 92 direct a small amount of secondary air at all times in an upward direction, past the spiral coil 166, so as to support secondary combustion of combustible gases, due to the catalytic coating 168 on the first or outer strip member 156. When a sufficient concentration of combustible gases and vapors reach the spiral coil 166, the combustion catalyst 168 on the outer strip member 156 produces catalytic combustion which heats the outer strip member 156 to a higher temperature than the temperature of the inner strip member 158, which is not catalyst-coated. The increased or differential heating of the outer strip member 156 causes the spiral coil to curl to a greater extent so that it coils up more tightly, whereby the shaft 172 and the secondary air valve plate 170 are rotated through a small angle in a clockwise direction. Such rotation increases the amount of secondary air admitted into the air inlet 140 through the openings 186 and 188. The additional secondary air causes increased secondary combustion in the secondary combustion chamber 136, so that the concentration of combustibles reaching the spiral strip 166 is reduced. Thus, the catalytic heating of the outer strip member 156 is reduced, so that the spiral coil 166 uncurls slightly and rotates the secondary air valve 170 in a counterclockwise direction, thereby reducing the amount of secondary air admitted into the secondary combustion chamber 136. This negative feedback type of secondary air regulation is much the same as previously described, and has the result of adjusting the secondary air supply to an optimal amount, whereby only a small concentration of combustible gases and vapors reaches the spiral coil 166. Thus, the catalytic heating of the outer strip member 156 is minimal. Any remaining combustibles are consumed by the catalytic combustion which occurs as the hot gases and vapors pass through the catalytic combustion plate 68.

Figure 10:
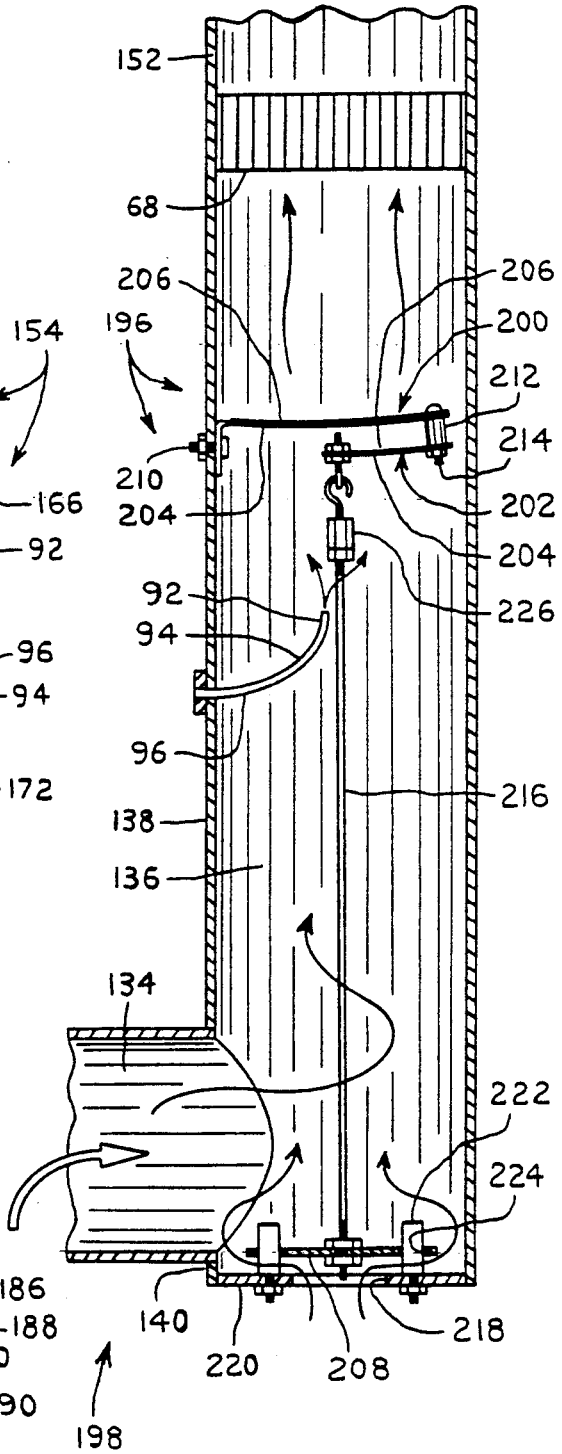
FIG. 10 is a fragmentary diagrammatic elevational section, showing another embodiment of the present invention, in the form of a self-powered automatic secondary air controller, comprising laminated actuator strips adapted to actuate a linearly movable secondary air valve, the strips having active and passive laminations, the active lamination being coated with a combustion catalyst, while the passive lamination is not similarly coated.

FIG. 10 is a diagrammatic illustration of a modified self-powered automatic secondary air controller 196, to be described as another illustrative embodiment of the present invention. The secondary air controller 196 is installed in a slightly modified woodstove 198 which is very similar to the woodstove 176 of FIG. 7, and comprises many of the same components, including the passage 134, the combustion chamber 136, the housing 138, the secondary air inlet 140, the catalytic combustion plate 68, the upper discharge portion 152 of the housing 138, and the nozzle 92 on the upper end of the small air tube 94 with its lower portion 96 extending laterally and connecting with the room air.

The secondary air controller 196 of FIG. 10 employs the same basic principles as the controller 154 of FIG. 7. However, in FIG. 10, the spiral coil 166 is not used, but is replaced with laminated strips 200 and 202 which are similar to the laminated strip 162 but are basically straight, rather than being curled into a coil. The cross section of each of the laminated strips 200 and 202 is the same as illustrated in FIG. 8. Thus, each of the laminated strips 200 and 202 comprises first and second strip members 204 and 206 riveted or otherwise fastened together, with a layer or strip of heat insulating material, such as asbestos, for example, interposed therebetween, the same as shown in the enlarged view of FIG. 9. As before, the strip members 204 and 206 are made of a highly heat resistant metal, metal alloy, or some other suitable material. As previously described in connection with FIG. 9, the first strip member 204 is provided with a coating of a combustion catalyst, such as platinum, palladium, or a mixture thereof, but the second strip member is not provided with any such coating. When the strip member 204 is heated by catalytic combustion, each of the laminated strips 200 and 202 curls upwardly, so as to produce a substantially linear movement of a secondary air valve plate 208, whereby additional secondary air is admitted into the secondary air inlet 140.

In the secondary air controller 196 of FIG. 10, the left hand end of the laminated strip 200 is securely anchored to one wall of the housing 138 by a bolt or other fastener 210. The right hand end of the laminated strip 200 is rigidly connected to the right hand end of the laminated strip 202 by suitable fastener means, illustrated as comprising a spacer 212 and a bolt 214. A hanger rod 216 is suitably connected between the left hand end of the laminated strip 202 and the vertically movable air valve plate 208. It will be understood that the references to left and right hand ends are purely relative, and can be reversed.

The secondary air valve plate 208 is movable toward and away from a central air entrance opening 218 in a stationary valve plate 220, connected across the secondary air inlet pipe 140. As shown in FIG. 10, the plate 220 is provided with vertical guide pins 222 which are loosely received in corresponding openings 224 in the vertically movable secondary air valve plate 208. A screw device 226 is provided at the upper end of the hanger rod 216 for initially adjusting the effective length thereof.

The operation of the secondary air controller 196 of FIG. 10 is much the same as the operation of the controller 154 of FIG. 7. When there is a sufficient concentration of combustible gases and vapors in the portion of the secondary combustion chamber 136 around the laminated strips 200 and 202, the first or lower strip members 204 of the laminated strips are heated by catalytic combustion, due to the combustion catalyst thereon, while the second or upper strip members 206 are not similarly heated, because of the lack of any combustion catalyst thereon. The greater heating of the first strip members 204 causes the laminated strips 200 and 202 to curl upwardly, so that the hanger rod 216 and the secondary air valve plate 208 are raised slightly. In this way, a greater space is opened between the movable valve plate 208 and the stationary valve plate 220, so that additional secondary air is admitted into the secondary combustion chamber 136. As a result, additional combustibles are burned in the lower portion of the secondary combustion chamber 136, so that less combustibles reach the laminated strips 200 and 202, whereby the catalytic combustion along the first strip members 204 is decreased. Accordingly, the upward curl of the laminated strips 200 and 202 is diminished, so that the hanger rod 216 and the secondary air valve plate 208 are lowered, whereby the supply of secondary air through the opening 218 is decreased. This negative feedback type of control results in the adjustment of the position of the secondary air valve plate 208 so that an optimal amount of secondary air is admitted into the secondary combustion chamber 136, whereby only a minimal concentration of combustibles reaches the first and second laminated strips 200 and 202. Any remaining combustibles are consumed by catalytic combustion in the catalytic combustion plate 68.

The secondary air controllers 154 and 196 of FIGS. 7 and 10 are self-powered, in that they are powered by differential thermal expansion and contraction of first and second members, one of which is coated with a combustion catalyst, while the other is not similarly coated. No electrical or other external power is required. The sensors in these secondary air controllers respond to changes in the concentration of combustible gases and vapors in the secondary combustion zones, and are not responsive to general temperature variations therein.

I claim:

1. A self-powered secondary air controller for a woodstove or the like having a secondary combustion chamber with a secondary air inlet as well as an outlet for the hot combustion products from primary and secondary combustion, said controller comprising:

sensor means including first and second bulbs filled with a fluid and located in the secondary combustion chamber remotely from the secondary air inlet, a movable air valve for increasing and decreasing the amount of secondary air admitted into the chamber through the air inlet, a differential pressure responsive actuator connected to said air valve for increasing the supply of secondary air in response to increasing differential fluid pressure, first and second fluid-carrying tubes connected from the respective first and second bulbs to said actuator, and combustion catalyst means for differentially heating said first bulb by catalytic combustion of combustible gases and vapors around said first bulb, said combustion catalyst means comprising a coating of a combustion catalyst on said first bulb, the differential heating of said first bulb being effective to produce differential fluid pressure which is transmitted to said actuator and causes said actuator to increase the supply of secondary air, to produce a negative feedback control, in that the increased secondary air causes increased secondary combustion and thereby reduces the concentration of combustible gases and vapors available for catalytic combustion by said combustion catalyst means.

2. A secondary air controller according to claim 1, said combustion catalyst means comprising a combustion catalyst device located with greater heat transfer to said first bulb than to said second bulb.

3. A secondary air controller according to claim 1, said combustion catalyst means comprising a catalytic combustion plate extending across said secondary combustion chamber near said outlet for hot combustion products, said first bulb being located adjacent said catalytic combustion plate for heat transfer therefrom, while said second bulb is located more remotely from said catalytic combustion plate.

4. A secondary air controller according to claim 3, in which said catalytic combustion plate has a recess in which said first bulb is received for close heat transfer between said plate and said first bulb.

5. A secondary air controller according to claim 1, in which each of said bulbs is made of a highly heat resistant metal material with a ceramic coating thereon.

6. A secondary air controller according to claim 5, said combustion catalyst means comprising an additional coating of a combustion catalyst on said first bulb.

7. A secondary air controller according to claim 1, said combustion catalyst means including platinum as a catalytic material.

8. A secondary air controller according to claim 1, said combustion catalyst means including palladium as a combustion catalyst.

9. A secondary air controller according to claim 1, in which said differential pressure responsive actuator comprises first and second Bourdon tubes connected to said respective first and second fluid-carrying tubes extending from said first and second bulbs, and connecting means for differentially connecting said Bourdon tubes to said movable air valve.

10. A secondary air controller according to claim 9, said connecting means comprising first and second balanced coil springs connected from said first and second Bourdon tubes to oppositely oriented portions of said movable air valve.

11. A secondary air controller according to claim 9, said first and second Bourdon tubes being oppositely oriented relative to said movable air valve, said connecting means comprising first and second balanced springs connected from said first and second Bourdon tubes and extending in opposite directions to said movable air valve.

12. A secondary air controller according to claim 1, in which said fluid is an inert gas.

13. A secondary air controller according to claim 1, including initial air supply means for supplying an initial supply of secondary air to the vicinity of said combustion catalyst means for supporting catalytic combustion.

14. A secondary air controller according to claim 13, said initial air supply means comprising an air inlet tube having a small air inletting capacity relative to the air inletting capacity of the secondary air inlet.

15. A secondary air controller according to claim 1, including a sampling tube in said secondary combustion chamber for receiving a sample of hot gases therefrom, said first and second bulbs being located in said sampling tube, said combustion catalyst means producing catalytic combustion of available combustible gases and vapors, and initial air supply means for supplying a small initial amount of secondary air to said sampling tube, said sampling tube having its own flue outlet for carrying away hot products of combustion.

16. A self-powered secondary air controller for a woodstove or the like having a secondary combustion chamber with a secondary air inlet as well as an outlet located remotely from the inlet for discharging hot products of primary and secondary combustion, said controller comprising:

a movable air valve for increasing and decreasing the amount of secondary air admitted into the secondary combustion chamber through the secondary air inlet, and self-powered means for monitoring the concentration of combustible gases and vapors at a location in the secondary combustion chamber remote from the air inlet and for actuating the movable air valve to increase the supply of secondary air in response to increasing concentrations of the combustible gases and vapors, said self-powered means comprising an elongated laminated strip having one end with a stationary mounting and a remote end with an actuating connection to said movable air valve, said laminated strip including first and second elongated strip members fastened together, and combustion catalyst means for heating said fist strip member to a greater extent than said second strip member for causing said laminated strip to be curled by differential thermal expansion, said combustion catalyst means including a coating of a combustion catalyst on said first strip member, the curling of said laminated strip being effective to actuate the air valve in a direction to increase the supply of secondary air through the inlet, whereby a negative feedback control is provided in that the increased supply of secondary air increases the secondary combustion in the chamber and thereby decreases the concentration of available combustible gases and vapors for catalytic combustion.

17. A secondary air controller according to claim 16, in which said first and second strip members are made of a highly heat resistant metal material.

18. A secondary air controller according to claim 16, in which said first and second strip members are fastened together with heat insulating material therebetween for reducing the conduction of catalytically produced heat therebetween.

19. A secondary air controller according to claim 18, including rivets for fastening said first and second strip members together with said insulating material therebetween.

20. A secondary air controller according to claim 16, in which said laminated strip is loosely coiled into a spiral coil having one end with a stationary mounting and the other end with an actuating connection to said movable air valve.

21. A secondary air controller according to claim 20, said movable air valve comprising a rotatable air valve member, said actuating connection extending between said spiral coil and said rotary air valve member.

22. A secondary air controller according to claim 21, said spiral coil having outer and inner ends, said outer end having the stationary mounting, said actuating connection extending between said inner end of said spiral coil and said rotary air valve member.

23. A secondary air controller according to claim 22, said actuating connection comprising a rotary shaft extending between the inner end of said spiral coil and said rotary air valve member.

24. A secondary air controller according to claim 16, said laminated strip being substantially straight and being adapted to curl increasingly with increased catalytic combustion along said first strip member having the coating of a combustion catalyst thereon, the curling of said laminated strip causing movement of said remote end thereof for actuating said movable air valve.

25. A secondary air controller according to claim 24, said movable air valve comprising a linearly movable air valve member, said actuating connection causing linear movement of said air valve member in response to the movement of the remote end of said laminated strip.

26. A secondary air controller according to claim 25, said actuating connection comprising a hanger rod extending between said remote end of said laminated strip and said linearly movable air valve member.

27. A secondary air controller according to claim 26, in which said laminated strip is the first laminated strip of a plurality of laminated strips, all of which are substantially the same in general construction as said first laminated strip, said laminated strips being additively connected together between the stationary mounting and the actuating connection for combining the curling movements of said laminated strips caused by catalytic combustion due to the combustion catalyst on the first strip member of each of said laminated strips.

28. A self-poWered secondary air controller for a woodstove having a secondary combustion chamber with a secondary air inlet for admitting secondary air into the chamber as well as an outlet located remotely from the inlet for discharging hot products of primary and secondary combustion from the combustion chamber, said secondary air controller comprising a mechanically movable air valve for increasing and decreasing the supply of secondary air admitted into the combustion chamber through the air inlet, sensor means for monitoring the concentration of combustible gases and vapors in said secondary combustion chamber at a location remote from said air inlet, said sensor means including first and second mechanical members, said sensor means also including catalytic combustion means for producing greater heating of said first member than of said second member due to catalytic combustion of combustible gases and vapors in the locality being monitored, said greater heating of said first member causing differential mechanical action between said first and second members, and actuating means for utilizing said differential mechanical action to move said movable air valve for increasing the supply of secondary air admitted to the secondary combustion chamber, whereby a negative feedback control is provided, in that the increase of secondary air causes increased secondary combustion in said chamber so that the concentration of combustible gases and vapors available for catalytic combustion is reduced.

29. A secondary air controller according to claim 28, said first and second members comprising first and second bulbs filled with a fluid, said catalytic combustion means being effective to cause greater heating of said first bulb than said second bulb so as to cause differential fluid pressures therein, said actuator means comprising a differential pressureoperated actuator having first and second fluid connections from said first and second bulbs to said actuator, said actuator being operative to operate the movable air valve for increasing the supply of secondary air in response to greater fluid pressure from said first bulb than from said second bulb.

30. A secondary air controller according to claim 29, said catalytic combustion means comprising a coating of a combustion catalyst on said first bulb to induce catalytic combustion therealong.

31. A secondary air controller according to claim 29, said catalytic combustion means comprising a catalytic combustion member in close proximity to said first bulb, said second bulb being more remote than said first bulb from said catalytic combustion member.

32. A secondary air controller according to claim 28, said first and second members comprising first and second elongated strip members fastened together to form a laminated strip, said catalytic combustion means producing greater heating of said first elongated strip member than of said second elongated strip member and thereby causing said laminated strip to curl due to differential thermal expansion of said first strip member relative to said second strip member, said laminated strip having first and second ends, said first end having a stationary mounting, said second end being movable due to the curling of said laminated strip, said actuating means including means connected between said second end of said laminated strip and said movable air valve for increasing the secondary air supply in response to the curling movement of said laminated strip.

33. A secondary air controller according to claim 32, said catalytic combustion means comprising a coating of a combustion catalyst on said first elongated strip member.

34. A secondary air controller according to claim 33, said laminated strip being loosely coiled to form a spiral coil.

35. A woodstove, comprising:

a firebox having outside walls with a combustion space therein, a plurality of generally horizontal grate tubes extending across said combustion space with spaces between said grate tubes, said grate tubes dividing said combustion space into a fuel loading chamber above said grate tubes and a secondary combustion chamber below said grate tubes, said grate tubes being adapted to support firewood to be burned, primary air inlet means for admitting primary air to said fuel loading chamber, said secondary combustion chamber having outlet means located remotely relative to said grate tubes for discharging products of combustion therefrom, and secondary air inlet means connecting with the interior of said grate tubes, self-powered secondary air controller having an air valve movable toward and away from the secondary air inlet means, and an actuator for operating the air valve, said grate tubes having walls with openings therein directed downwardly into said secondary combustion chamber for directing secondary air downwardly to support secondary combustion in said combustion chamber of combustible gases and vapors passing downwardly into said secondary combustion chamber through said spaced between said tubular grates, and self-powered secondary air controller producing the desired regulation of the secondary air admitted into the secondary air inlet.

* * * * *